US005309769A

United States Patent [19]

Yamakita

[11] Patent Number: 5,309,769

[45] Date of Patent: May 10, 1994

[54] METHOD OF METERING THE RATE OF FLOW OF A DYE SOLUTION

[75] Inventor: Yoshimichi Yamakita, Uozu, Japan

[73] Assignee: Yoshida Kogyo K.K., Tokyo, Japan

[21] Appl. No.: 32,122

[22] Filed: Mar. 17, 1993

[30] Foreign Application Priority Data

Apr. 1, 1992 [JP] Japan ..... 4-109363

[51] Int. Cl.[5] ..... G01S 1/00

[52] U.S. Cl. ..... 73/861; 73/198

[58] Field of Search ..... 73/168, 198, 861, 865.9; 222/74; 18/400

[56] References Cited

U.S. PATENT DOCUMENTS 4,433,811 2/1984 Godfrey ..... 239/74
4,896,539 1/1990 Salyani et al. ..... 73/861
5,081,731 1/1992 Yamakita ..... 8/151

FOREIGN PATENT DOCUMENTS 2307960 12/1990 Japan .

*Primary Examiner*—Herbert Goldstein
*Attorney, Agent, or Firm*—Hill, Steadman & Simpson

[57] ABSTRACT

A method of metering the rate of flow of a dye solution from a spray nozzle for dyeing an elongate fabric material comprises spraying a test liquid equivalent to the dye solution over a plate member impervious to liquid, accumulating the test liquid and measuring the rate of its flow per unit length of time, thereby evaluating the performance of the spray nozzle. The rate of flow of such test liquid is simulated for actual dyeing operation to pre-adjust the jet pressure of the spray nozzle and/or the spaced of feed of the fabric material so as to attain uniform intensity of color on the dyed material.

5 Claims, 1 Drawing Sheet

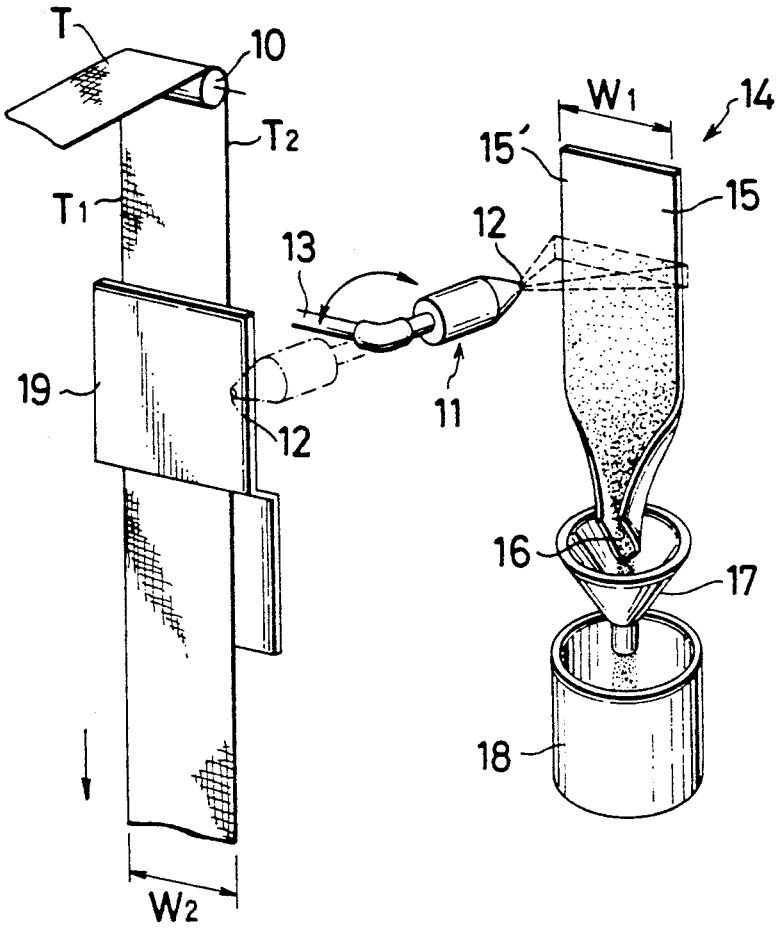
T
10
T2
T1
13
12
19
12
11
W1
14
15'
15
16
17
18
W2

METHOD OF METERING THE RATE OF FLOW OF A DYE SOLUTION

BACKGROUND OF THE INVENTION

1. Field of the Invention

This invention relates to a method of metering the rate of a dye solution to be applied by a spray nozzle to an elongate cloth article such as a slide fastener chain, a slide fastener stringer tape, a surface fastener, a ribbon and the like.

2. Prior Art

Spray coating is one of the most widely used techniques for dyeing an elongate web material such as textile tapes as typically disclosed in Japanese Laid-Open Patent Publication No. 2-307960 in which there is disclosed a spray dyeing apparatus including a spray nozzle for applying a jet of liquid dye to a tape material while the latter is being fed continuously in a vertically upward or downward direction.

SUMMARY OF THE INVENTION

In order for the material to be dyed at a uniform density of color and hue, it is always necessary to control both the amount of dye solution to be applied and the speed of feed of the material to be dyed. Usually, the jet pressure of a dye solution from a spray nozzle is adjusted to provide a desired color intensity. However, for one reason or another, irregularities would often occur in the color intensity of a finished material despite normal daily operating supervision. It has been found that the principal cause for such a dyeing problem is associated with the spray nozzle used for atomizing and applying a dye solution to a given fabric material and particularly in most cases attributable to the nozzle being plugged up or its tip being worn by abrasion, resulting in variations in the jet opening of the nozzle and hence in irregularly or defectively dyed material.

It has also been found that even with new spray nozzles, tolerances for their tip size would somehow affect the amount of a dye solution to be applied. Such discrepancies in the rate of dye spray coating were unpredictable pending the appearance of a particular finished tape product, so that considerable textile materials would have been wasted when found defectively colored.

With the foregoing problems of the prior art in view, the present invention seeks to provide a novel method of metering the rate of a dye solution to be applied to an elongated fabric material whereby the material can be dyed to a uniform color intensity.

The above and other objects and features of the invention will appear clear from the following description taken in connection with the accompanying drawing.

According to the invention, there is provided a method of metering the rate of flow of a dye solution from a spray nozzle for dyeing an elongate fabric material, which method comprises positioning the spray nozzle rotatably between a vertically supported plate member and a vertical run of the fabric material, spraying a test liquid equivalent to the dye solution over the plate member substantially equal in width to the fabric material to be dyed, allowing the test liquid to flow by gravity down the plate member, and measuring the rate of flow of the liquid per unit length of time as it is accumulated in a reservoir.

BRIEF DESCRIPTION OF THE DRAWING

FIG. 1 is a diagrammatic perspective view of an apparatus employed for carrying the method of the invention into practice.

DETAILED DESCRIPTION OF THE INVENTION

Referring to FIG. 1, there is shown a fabric material T in the form of an elongated tape having a width $W_2$ which is fed at a predetermined rate of speed vertically downward in the direction of the arrow past a guide roll 10.

Designated at 11 is a spray nozzle having a tip or jet opening 12 and rotatably mounted on a supply conduit 13 through which a liquid dye or dye solution (not shown) is supplied from a dye reservoir (not shown). The supply conduit 13 is rotatable by means not shown so as to rotate the spray nozzle 11 substantially through 180°.

A metering apparatus 14, a preferred means for carrying out the method of the invention, comprises a plate member 15 having a width $W_1$ substantially equal to the width $W_2$ of the fabric tape T and supported vertically in a position registering in confronting relation with a vertical run $T_1$ of the tape T and spaced apart therefrom by a distance such that the distance between the tip 12 of the nozzle 11 and the inner surface 15' of the plate member 15 is substantially equal to the distance between the tip 12 of the nozzle 11 and the inner surface $T_2$ of the fabric tape T when the nozzle 11 is flipped back toward the tape T as indicated by phantom line.

The plate member 15 is formed from a metal, synthetic resin, glass or like material which is impervious to liquid and glazed to a mirror-like surface such that a test liquid such as a dye solution cannot lend itself to deposit thereon. The plate member 15 has its lower portion inwardly folded or squeezed to form a narrow gutter portion 16 opening into a funnel 17 communicating with a metering receptacle 18.

In the practice of the invention, prior to a start of the dying operation by the spray nozzle 11 whether already used or newly replaced, a test liquid L equivalent to a dye solution to be actually applied or other solution having substantially the same viscosity, temperature and other properties as the dye solution is supplied through the supply conduit 13 and applied in atomized form over the inner surface 15' of the plate member 15, in which instance excess of the test liquid L is applied slightly beyond the full width of the plate member 15 to ensure full and complete coating coverage of the entire plate surface region in a manner simulative to the actual dyeing operation on the fabric tape T. The test liquid L flows by gravity down the plate surface 15', gathers at the gutter portion 16 and thence passes through the funnel 17 into the metering receptacle 18.

The rate of flow of test liquid L that has been accumulated in the receptacle 18 over a unit length of time is measured. The thus measured rate of test liquid L is representative of the rate of flow of a dye solution actually applied to the tape T and is a parameter indicative of the performance of the spray nozzle 11 used. It is therefore possible to determine the operating characteristics of a given spray nozzle from the rate of flow of test liquid L per unit length of time and thus to dye the tape T to a desired color intensity and uniformity by adjusting the jet pressure of the spray nozzle 11 and/or the speed of travel of the tape T in advance of start-up of the dyeing operating with a spray nozzle already used or with a replaced new spray nozzle.

Designated at 19 is a buffer plate mounted on the reverse side of the tape T to prevent drain of excess dye.

Whilst the tape T is illustrated as being fed vertically downward, it may be alternatively fed vertically upward.

Obviously, various modifications and variations of the present invention are possible in the light of the above teaching. It is therefore to be understood that within the scope of the appended claims the invention may be practiced otherwise than as specifically described.

What is claimed is:

1. A method of metering the rate of flow of a dye solution from a spray nozzle for dyeing an elongate fabric material, which method comprises positioning said spray nozzle rotatably between a vertically supported plate member and a vertical run of said fabric material, spraying a test liquid equivalent to said dye solution over said plate member substantially equal in width to said fabric material to be dyed, allowing said test liquid to flow by gravity down said plate member, and measuring the rate of flow of said liquid per unit length of time as it is accumulated in a reservoir.

2. A method according to claim 1 wherein said spray nozzle is spaced equi-distance apart from said plate member and said vertical run of said material, respectively.

3. A method according to claim 1 wherein said plate member is formed from a material impervious to liquid.

4. A method according to claim 1 wherein said plate member is glazed to prohibit deposit thereon of said test liquid.

5. A method according to claim 1 wherein said test liquid has substantially the same viscosity and temperature as said dye solution.

* * * * *